US007000697B2

(12) United States Patent
Goode et al.

(10) Patent No.: US 7,000,697 B2
(45) Date of Patent: Feb. 21, 2006

(54) DOWNHOLE MEASUREMENT APPARATUS AND TECHNIQUE

(75) Inventors: Peter A. Goode, Houston, TX (US); Rod Nelson, Sugar Land, TX (US); David Rossi, Katy, TX (US); Terizhandur S. Ramakrishnan, Bethel, CT (US); Min-Yi Chen, W. Redding, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/992,681

(22) Filed: Nov. 19, 2001

(65) Prior Publication Data

US 2003/0094282 A1 May 22, 2003

(51) Int. Cl.
*E21B 47/00* (2006.01)

(52) U.S. Cl. ..... 166/250.17; 166/66; 166/100; 166/250.11; 166/179; 73/152.17; 73/152.26; 73/152.36

(58) Field of Classification Search ..... 166/250.17, 166/250.11, 250.07, 100, 264, 66, 179; 73/152.17, 73/152.14, 152.26, 152.24, 152.25, 152.36, 73/152.51, 152.53; 324/367, 368, 374
See application file for complete search history.

(56) References Cited

U.S. PATENT DOCUMENTS 2,313,369 A * 3/1943 Lloyd ..... 175/4.52
2,712,630 A 7/1955 Doll
3,121,459 A 2/1964 Ness, Jr. et al.
3,169,578 A 2/1965 Voetter
3,265,132 A 8/1966 Edwards, Jr.
3,318,384 A 5/1967 Brown
3,348,621 A * 10/1967 Schuster ..... 175/4.52
3,361,207 A 1/1968 Chenoweth
3,391,741 A 7/1968 Elliston
3,414,071 A * 12/1968 Alberts ..... 175/4.51
3,420,306 A 1/1969 Brown
3,422,899 A 1/1969 Brown
3,424,243 A * 1/1969 Lawrence ..... 166/100
3,526,277 A 9/1970 Scott
4,263,968 A 4/1981 Garner, Jr.
4,369,654 A * 1/1983 Hallmark ..... 73/152.26
4,791,992 A 12/1988 Greenlee et al.
4,820,989 A 4/1989 Vail, III
4,882,542 A 11/1989 Vail, III
4,962,665 A * 10/1990 Savage et al. ..... 73/152.28
4,986,350 A 1/1991 Czernichow (Continued)

FOREIGN PATENT DOCUMENTS

EP 0255976 A3 2/1988

(Continued)

OTHER PUBLICATIONS

Schiumberger, "Cased Hole Formation Resistivity (CHFR) Tool", Mar. 2000 pp. 1-3.

*Primary Examiner*—Hoang Dang
(74) *Attorney, Agent, or Firm*—Trop, Pruner & Hu, P.C.; Kevin P. McEnaney; Jaime A. Castano

(57) ABSTRACT

A system that is usable with a subterranean well that has a casing includes an apparatus that is associated with production of fluid from the well and is located downhole in the well in a passageway of the casing. The system also includes a sensor that is located downhole near the apparatus in the passageway and is adapted to measure a characteristic of the formation fluids and rock located outside of the casing.

39 Claims, 13 Drawing Sheets

U.S. PATENT DOCUMENTS 5,043,668 A 8/1991 Vail, III
5,056,595 A 10/1991 Desbrandes
5,065,619 A 11/1991 Myska
5,181,565 A 1/1993 Czernichow
5,187,440 A 2/1993 Vail, III
5,195,588 A 3/1993 Dave
5,243,562 A 9/1993 Laurent et al.
5,303,773 A 4/1994 Czernichow et al.
5,353,637 A 10/1994 Plumb et al.
5,355,952 A 10/1994 Meynier
5,467,823 A 11/1995 Babour et al.
5,503,225 A 4/1996 Withers
5,509,474 A * 4/1996 Cooke, Jr. ..... 166/64
5,517,854 A 5/1996 Plumb et al.
5,642,051 A 6/1997 Babour et al.
5,662,165 A 9/1997 Tubel et al.
5,692,565 A * 12/1997 MacDougall et al. ..... 166/264
5,732,776 A * 3/1998 Tubel et al. ..... 166/250.15
5,765,637 A * 6/1998 Dietle et al. ..... 166/55
5,829,520 A 11/1998 Johnson
5,914,911 A 6/1999 Babour et al.
6,061,634 A 5/2000 Belani et al.
6,772,839 B1 * 8/2004 Bond ..... 166/298
2001/0026156 A1 10/2001 Dubourg et al.

FOREIGN PATENT DOCUMENTS

GB 2250826 A 6/1992
GB 2305249 A 4/1997
GB 2360849 A 10/2001
WO WO 00/65380 A1 11/2000
WO WO01/65067 A1 9/2001

* cited by examiner

DOWNHOLE MEASUREMENT APPARATUS AND TECHNIQUE

BACKGROUND

The invention generally relates to a downhole measurement apparatus and technique.

Measurements typically are performed downhole on a periodic or continuous basis in a subterranean well for purposes of obtaining information about subterranean formations and the fluids present in these formations. These may include pressure, voltages/currents, gravity or force, gamma ray and nuclear magnetic resonance measurements, as just a few examples. Downhole measurements typically are performed before production begins for purposes of locating production zones.

To conduct downhole measurements in a cased well during production, sensors have been conventionally lowered via wireline electrically conductive cables and more recently positioned on the exterior wall of the well casing. For example, sensors that measure resistivity are traditionally positioned on the outside of an insulated well casing to measure the flow of currents through the surrounding formation(s). The casing-mounted sensors typically are mounted on the exterior of well casing sections before the well casing sections are installed downhole and are usually cemented in place. Each casing-mounted sensor is thus permanently installed, and thus, the sensor cannot be replaced if the sensor fails, a failure may become more likely over time. Other problems associated with sensors that are positioned on the exterior of the well casing include challenging issues relating to the placement of sensors and the routing of communication lines to the sensors. Problems associated with sensors lowered at the end of conductive cables include loss of production due to closing of well to make measurements, disruption of fluids one is trying to measure and inability to measure steady state flowing conditions due to need for modification of flow to lower cable etc, just to name a few.

Thus, there is a continuing need for an arrangement that addresses one or more of the problems that are stated above.

SUMMARY

In an embodiment of the invention, a system that is usable with a subterranean well that has a casing includes an apparatus that is associated with production of fluid from the well and is located downhole in the well in a passageway of the casing. The system also includes a sensor (or sensors) that is located downhole near the apparatus in the passageway and is adapted to measure a characteristic of the formation fluids and rock located outside of the casing.

In another embodiment of the invention, technique that is usable with a subterranean well includes establishing a sealed region downhole and within the sealed region, piecing a casing of the well. Without flowing fluids uphole from the sealed region, the pierced casing is used to measure a characteristic associated with a region outside of the casing.

In yet another embodiment of the invention, an apparatus that is usable with a subterranean well that has a casing includes a punch and a sensor. The punch is to be positioned inside a passageway of the casing to pierce the casing to establish communication with a region outside of the casing. The sensor is to be positioned inside the passageway of the casing to indicate a characteristic that is associated with the region.

Advantages and other features of the invention will become apparent from the following drawing, description and claims.

DETAILED DESCRIPTION

Figure 1:
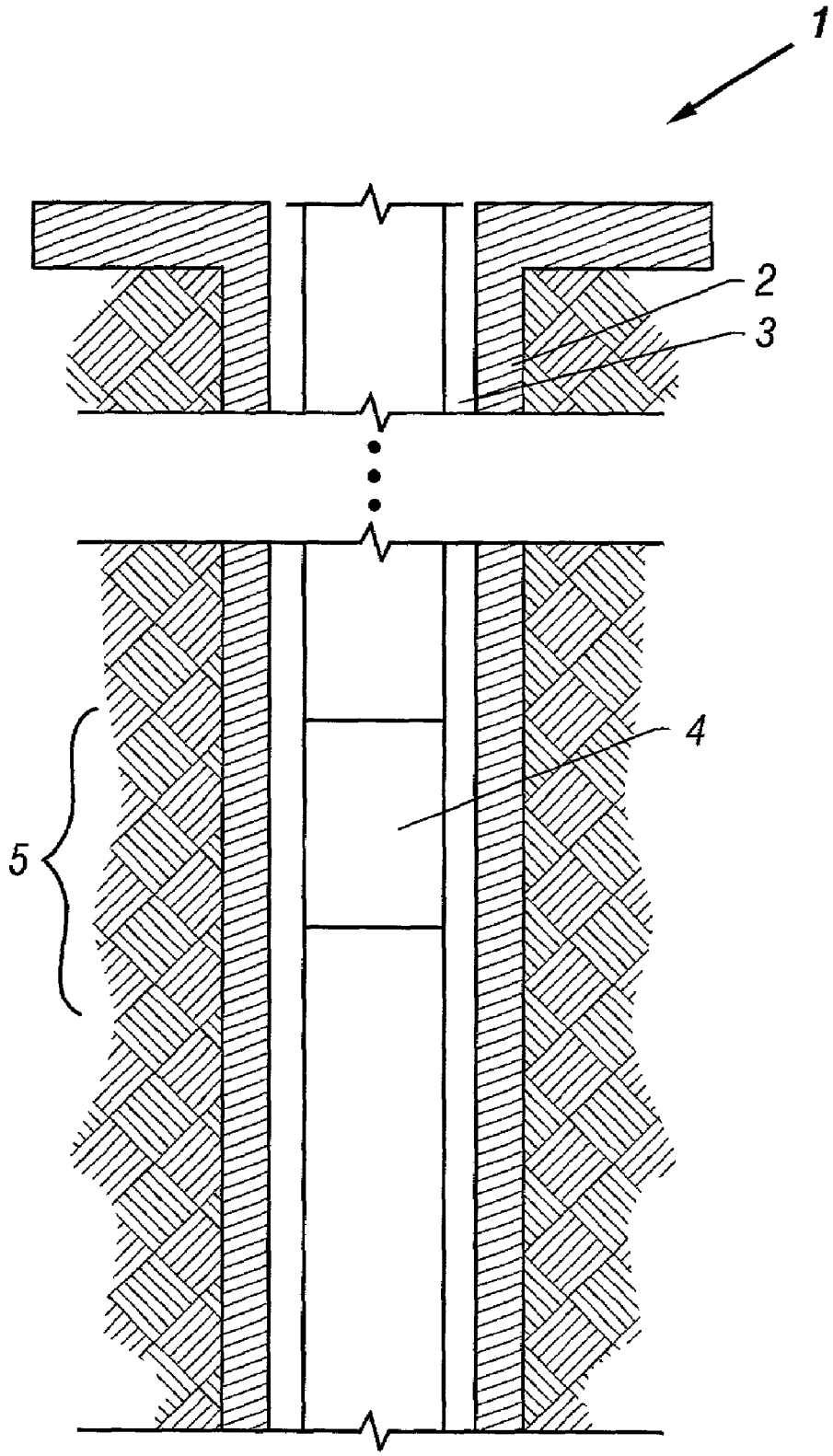
FIGS. 1, 2, 13, 14, 16 and 17 are schematic diagrams of subterranean wells according to embodiments of the invention.

Referring to FIG. 1, an embodiment 1 of a system for a subterranean well in accordance with the invention includes a casing 2 that may line a main vertical wellbore of the well (as depicted in FIG. 1) or line possibly other lateral wellbores of the well. The casing 2 may be secured in place via cement (not shown). Unlike conventional arrangements, the system 1 includes at least one sensor assembly 4 that is deployed downhole inside the central passageway of the casing 2 to measure properties of formation(s) that surround the casing 2 (i.e., measurements that extend beyond the exterior surface of the casing 2) during the production of well fluid from the well. Thus, the potential difficulties that are associated with deploying such a sensor downhole with the installation of the casing are circumvented due to the ability of the sensor assembly 4 to perform measurements through the casing 2. As described below, depending on the particular embodiment, the sensor assembly 4 may perform measurements outside of the casing 2 without piercing or puncturing the casing 2. In other embodiments of the invention, the sensor 4 may pierce the casing 2 to perform such measurements, as also described below.

As a more specific example, in some embodiments of the invention, the sensor assembly 4 may be deployed downhole as part of a production string 3 that extends through the central passageway of the casing 2 and is used to communicate well fluids from downhole to the surface of the well. Unlike conventional arrangements, the production string 3 includes sensor assemblies, such as the sensor assembly 4, that are deployed downhole with the production string 3. As described below, the sensor assembly 4 may be part of a packer, a component of the production string. However, alternatively, the sensor assembly 4 may be associated with production tools or equipment that are not coupled to a production string. For example, the sensor assembly 4 may be a packer that is deployed downhole via a wireline-based tool. However, regardless of the technique that is used to deploy the sensor assembly 4 downhole, the system 1 permits characteristics of the well outside of the casing 2 to be monitored over time during production without requiring a sensor to be deployed downhole in conjunction with the installation of the casing.

The sensor assembly 4 may include one or more sensors, such as acoustic, voltages/current, pressure, nuclear, gravity/force, electromagnetic and temperature sensors, as just a few examples. As described below, in some embodiments of the invention, the sensor assembly 4 may pierce the casing 2, such as the scenario in which the sensor assembly 4 includes a pressure sensor to sense a formation pressure outside of the casing 2 via a puncture hole that is formed in the casing 2 and cement (not shown). However, in other embodiments of the invention, the sensor assembly 4 does not pierce the casing 2, and the assembly's sensors perform measurements through the casing 2. Both penetrating and non-penetrating embodiments of the sensor assembly 4 are described below.

In some embodiments of the invention, measurements in a completed producing well may be made outside of the casing without piercing the casing. For example, referring to FIG. 13, in some embodiments of the invention, a sensor assembly 610 may be used to perform measurements outside of a well casing 602 without piercing the casing 602. As an example, in some embodiments of the invention, the sensor assembly 610 may include a non-acoustic sensor, such as a resistivity sensor or an acoustic sensor, as examples. It is assumed below that each sensor assembly 610 performs resistivity measurements. However, other types of sensor assemblies may alternatively be used.

Figure 13:
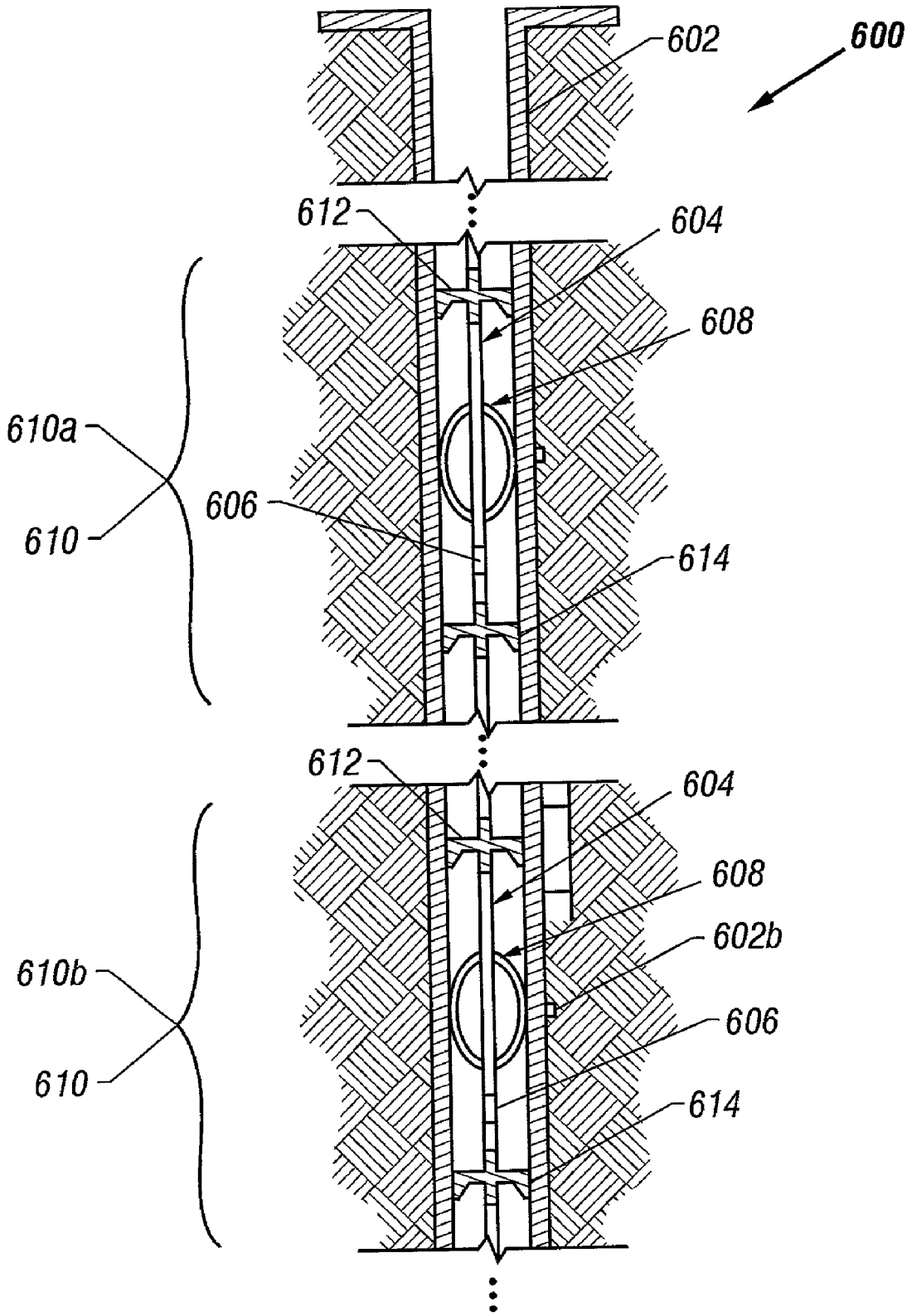

Several sensor assemblies 610 may be used as part of the completion, such as assemblies 610*a* and 610*b* that are depicted in FIG. 13. Some of the assemblies 610 may be used as transmitters for purposes of performing resistivity measurements, and some may be used as receivers, as can be appreciated by those skilled in the art. For example, the assembly 610*a* may transmit a current to the casing 602, and the assembly 610*b* may receive a current from the casing 602, a received current that indicates resistivity. As an example, the assemblies 610 may be mounted on a production string 604 (for example) that extends through the central passageway of the casing 602.

Each assembly 610 includes bow springs 608 that serve as electrical contacts to the casing 602 by flexing outwardly as depicted in FIG. 13 to contact the interior wall of the casing 602. These contacts, in turn, permit electronics 606 of each assembly 610 to transmit (if the assembly 610 is a transmitter) or receive (if the assembly 610 is a receiver) current to/from the contacted points of the well casing 602. It is noted that a significant amount of the current used for resistivity measurements is shunted through the electrically conductive casing 602. However, some of this current flows through the formation that surrounds the casing 602 and thus, the surrounding formation affects the resisitivity measurements significantly enough to measure properties of the formation. A system is described below for possibly improving the signal-to-noise ratio (SNR) of this measurement.

As depicted in FIG. 13, in some embodiments of the invention, each assembly 610 includes electrically insulative, elastomeric upper 612 and lower 614 wipers that isolate any fluid that surrounds the bow springs 608 (of the particular assembly 610) to prevent current from being communicated between adjacent assemblies 610 through fluid inside the casing 602.

Figure 14:
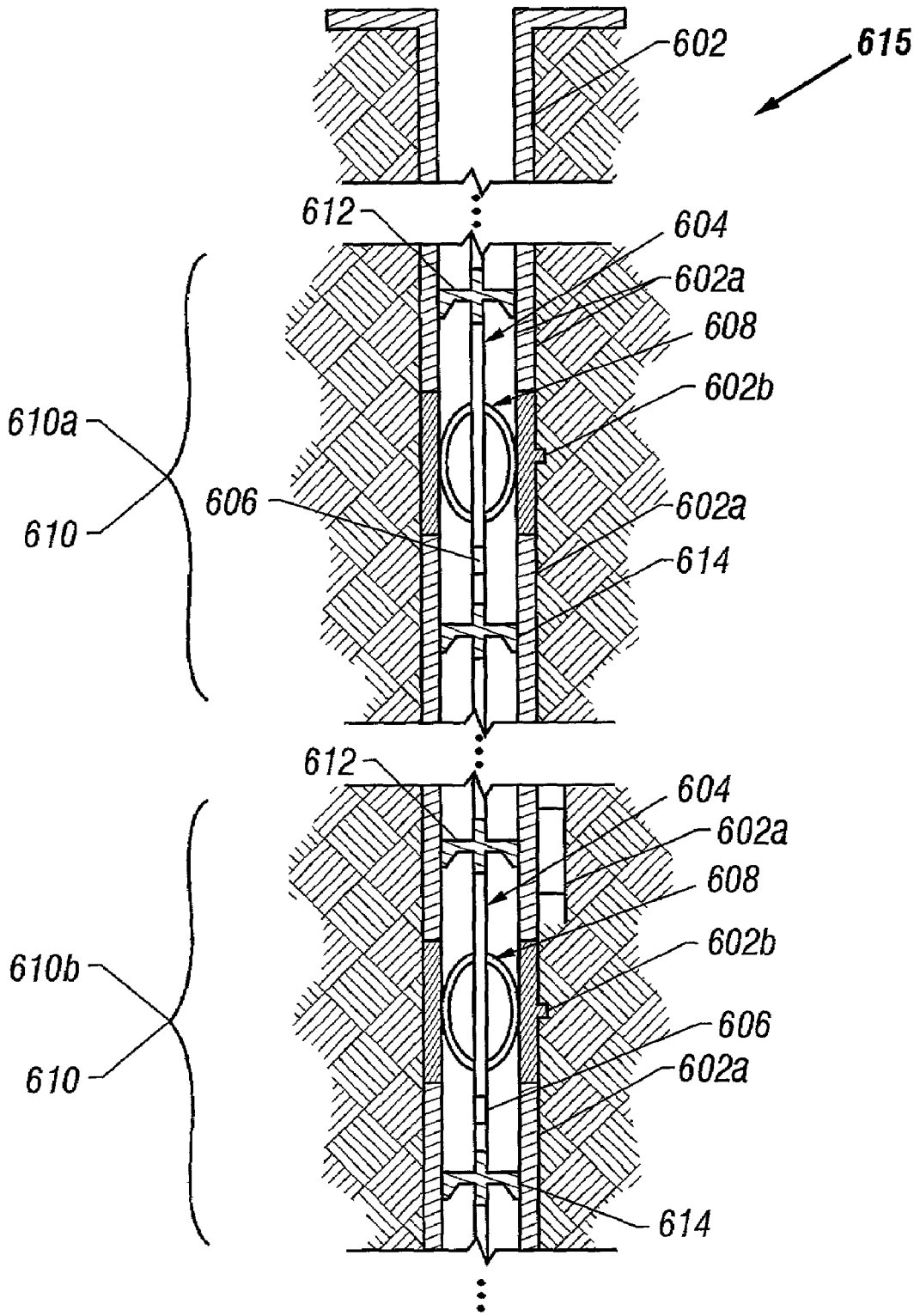

As noted above, a significant amount of current that is used for resistivity measurements may be shunted through the electrically conductive casing 602. This shunted current, in turn, degrades the SNR of the resistivity measurements. For purposes of improving the SNR of these measurements, a system 615 that is depicted in FIG. 14 may be used. The system 615 is similar to the system 600 of FIG. 13 except that the electrically conductive steel casing 602 of the system 600 has been replaced by a casing 603. Unlike the casing 602, the casing 603 is formed from electrically conductive sections 603*b* (steel sections, for example) that are interleaved with electrically insulative sections 603*a* (composite sections, for example) of the casing 603.

Each assembly 610 is positioned in the well so that its bowsprings 608 contact one of the electrically conductive sections 603*b* of the casing 603. Because the contacted electrically conductive section 603*b* is in contact with the surrounding formation, the assembly 610 may use its contact with the electrically conductive section 603*b* to transmit current or receive current for purposes of conducting a resistivity measurement.

The system 615 establishes a significantly higher SNR for resistivity measurements due to the isolation of each electrically conductive section 603 by the insulative sections 603*a* that are located above and below the electrically conductive section 603. In this manner, the isolation of the electrically conductive section 603*b* (that is contacted by the bow springs 608 of a particular assembly 610) from the other electrically conductive sections 603*b* prevents the casing 603 from shunting a significant level of current between the transmitters and receivers. As a result, the SNR of resistivity measurements is improved.

Figure 15:
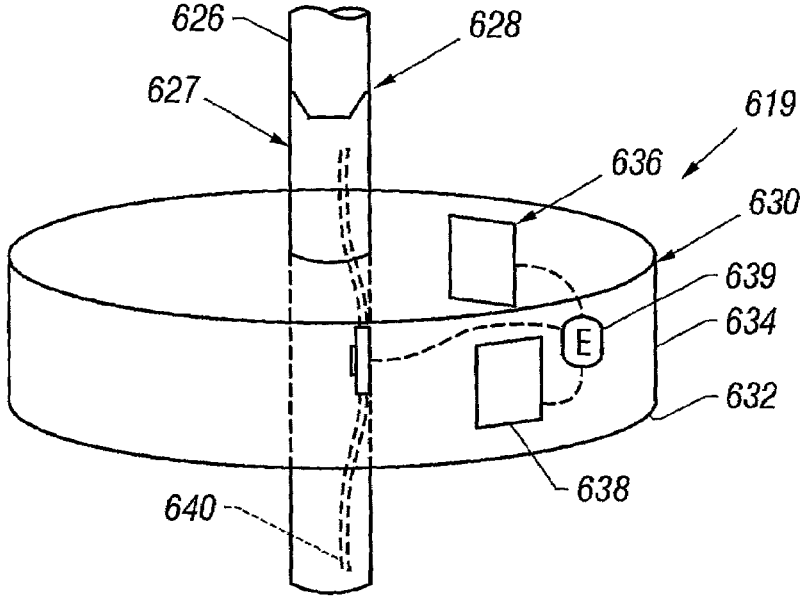
FIG. 15 is a schematic diagram of a packer according to a different embodiment of the invention.

FIG. 15 depicts a packer 619 that may be used to deploy sensors downhole in a completion in which production is occurring. Unlike the packer 16 that is described above, the sensors perform measurements without piercing a well casing that surrounds the packer 16. The packer 619 may include such sensors as a temperature gauge 638 and/or a resistivity gauge 636, as just a few examples. In this manner, these sensors may be placed on an outer surface of an elastomeric element 634 of the packer 619 so that when the element 634 expands, the sensors are pressed against the inner wall of the well casing.

Among the other features of the packer 619, the packer 619 may be part of a production string 626 that includes an insulative tubing section 627 on which the packer 619 is mounted. The insulative tubing section 627 may be connected to a tubing joint 628 of the production string 628 and serve to prevent the production string 626 from shunting currents that may be transmitted or received by the sensors. The sensors are coupled to an electronics module 639 (of the packer 619) that controls the measurements that are performed by the sensors and communicates with other circuitry in the well bore or at the surface of the well via an electrical cable 640 that extends through a passageway of the production string 626.

Figure 16:
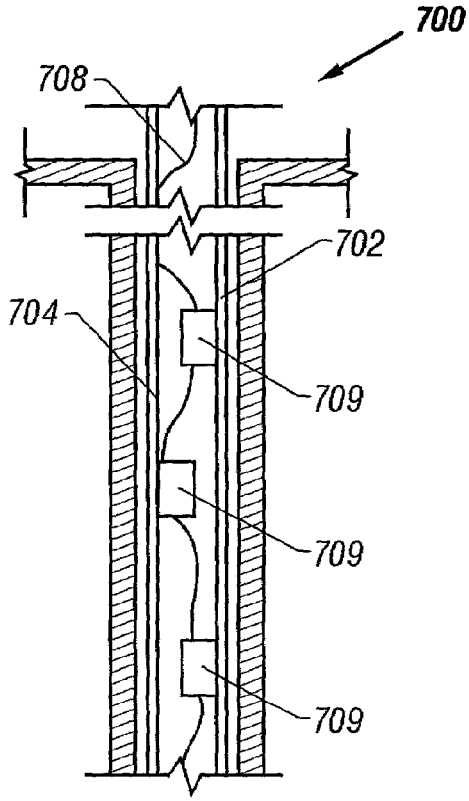

Referring to FIG. 16, in some embodiments of the invention, sensors 709 may be connected at points along an electrical cable 708 to form a network of sensors. This network may be deployed downhole inside a central passageway of a string 704, such as a coiled tubing, for example. In this manner, the string 704 may be used as part of a completion to communicate fluids to the surface of the well via the central passageway of the string 704. The electrical connections between the sensors 709 and cable 708 are sealed to isolate the fluid inside the central passageway from these electrical connections.

Figure 17:
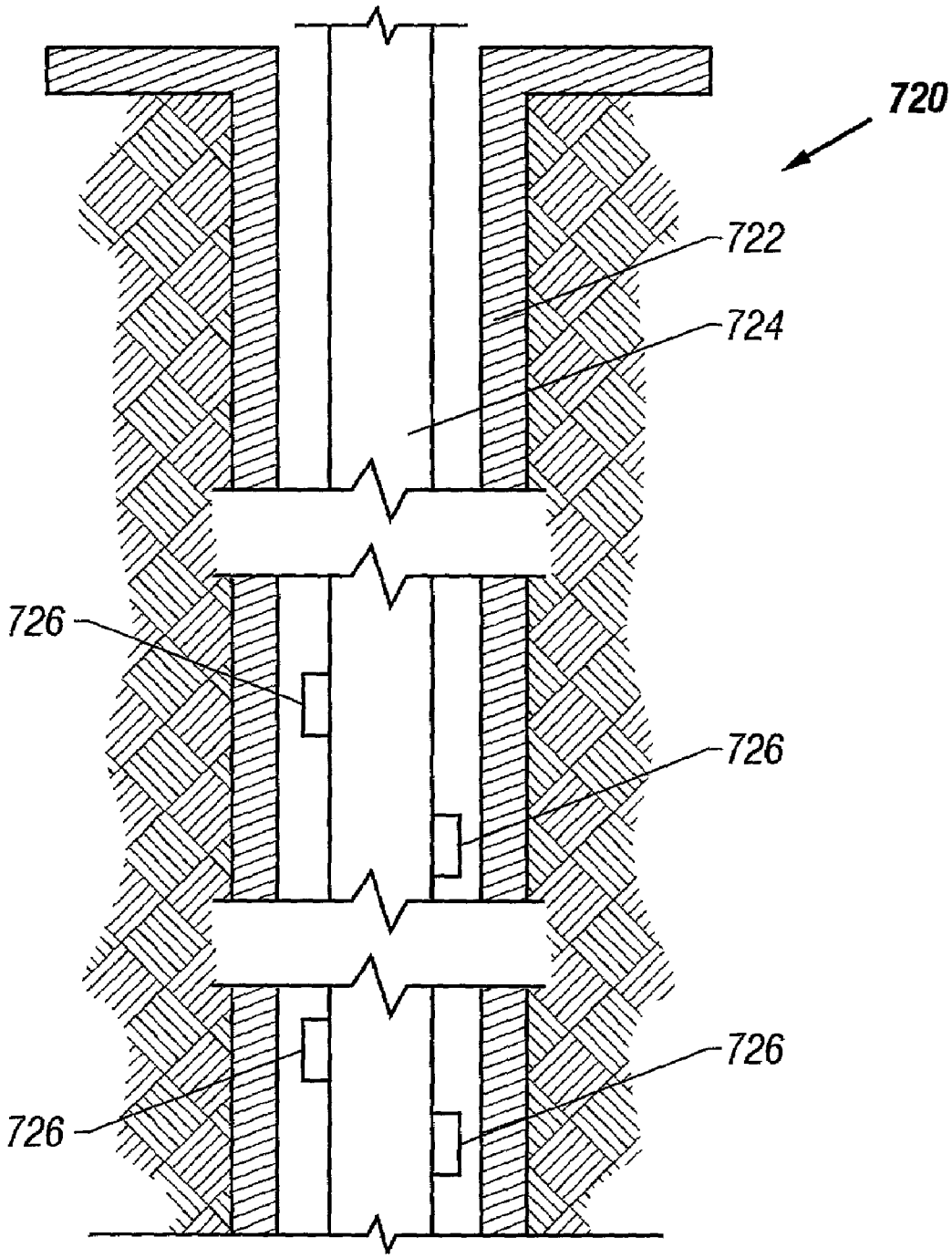

Referring to FIG. 17, as yet another example of a possible embodiment of the invention, a system 720 for use in a completion includes pocket sensors 726 that are attached to the exterior surface of a production string 724 that extends downhole inside a central passageway of a casing 722. Other variations are possible.

Figure 18:
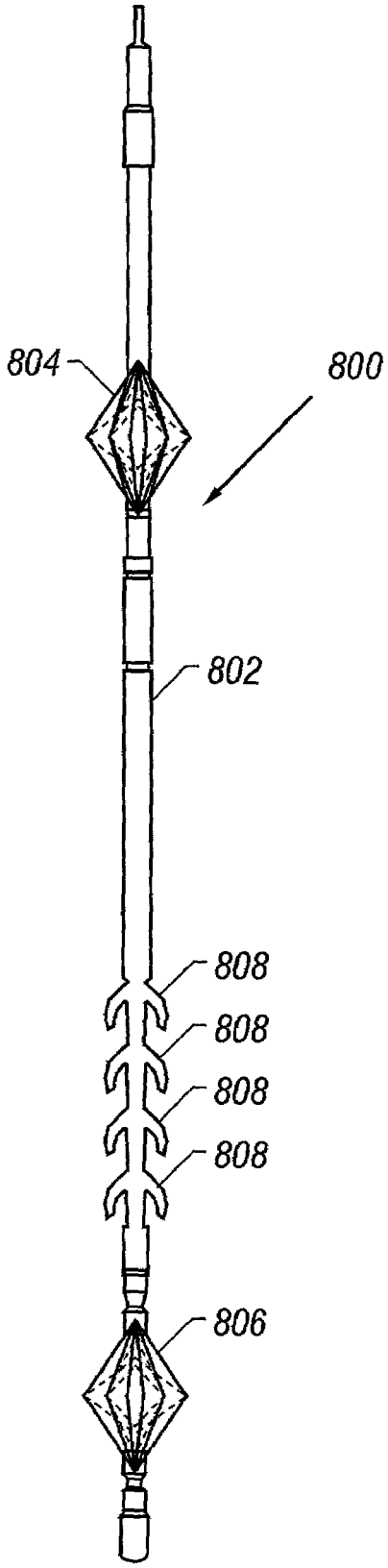
FIG. 18 is a schematic diagram of a resistivity tool according to an embodiment of the invention.

As a more specific example of a downhole resistivity tool, FIG. 18 depicts an embodiment 800 of a resistivity tool that measures the formation resistivity. The tool 800 includes an electronics module 802, a current injection electrode 804 that serves as a centralizer for the tool 800, four sets 808 of voltage electrodes and a current return electrode 806 that serves as a centralizer for the tool 800.

Figure 19:
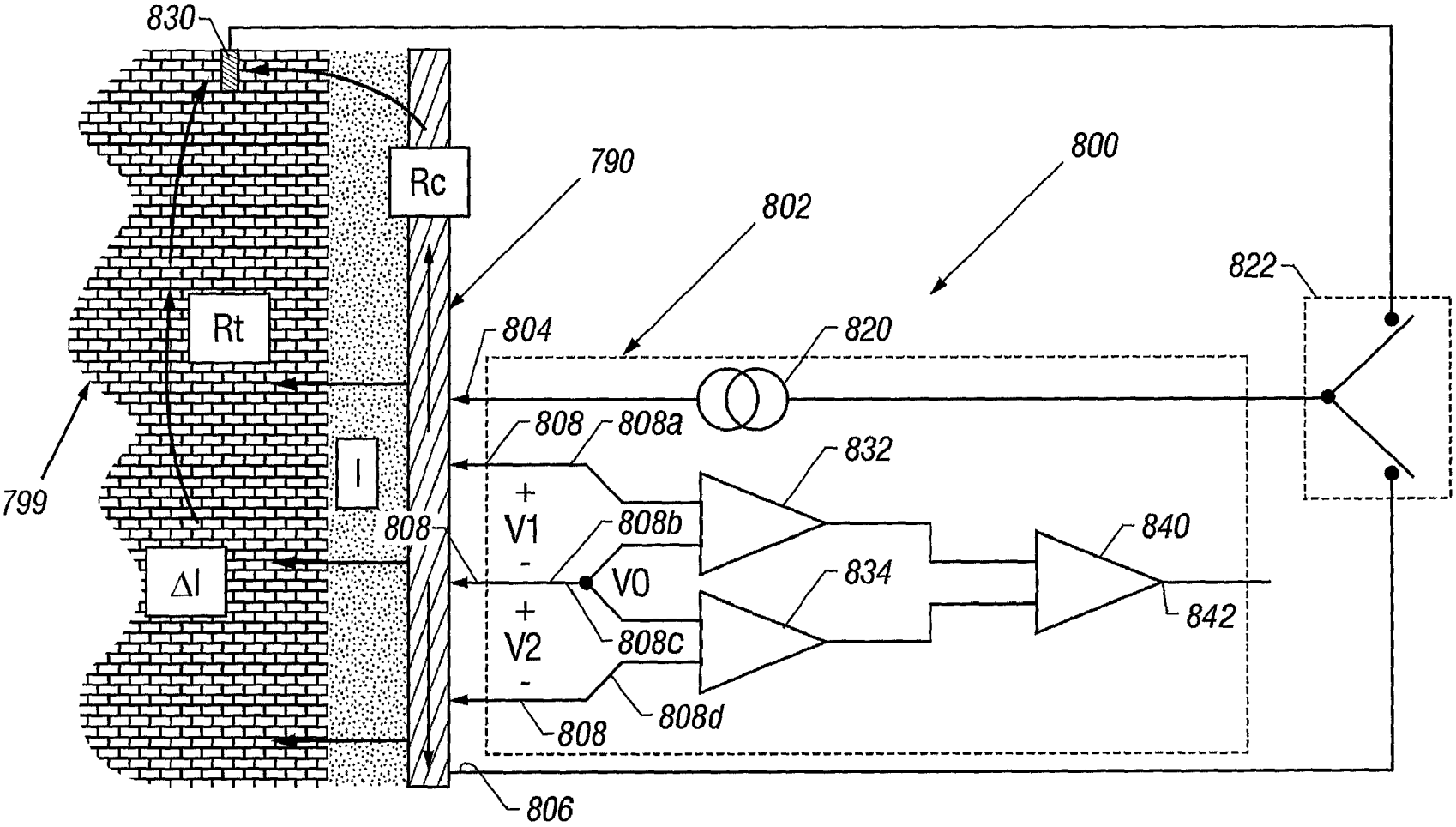
FIG. 19 is a schematic diagram of an electronics module of the resistivity tool according to an embodiment of the invention.

Referring to FIG. 19, in some embodiments of the invention, the sets 808 of voltage electrodes (electrodes 808*a*, 808*b*, 808*c* and 808*d*, as examples) may be used to measure two differential voltages called V1 and V2. The electrode sets 808 are regularly spaced along the longitudinal axis of the tool 800, and each electrode set 808 may be formed from multiple pads that are connected together in parallel for redundancy. When the tool 800 is installed inside a well casing 790, the sets 808 of electrodes establish physical contact with the interior surface of the well casing 790 and establish electrical connections with the well casing 790 at the physical contact points. The electrodes 804 and 806 also contact the interior of the well casing 790.

In some embodiments of the invention, to perform a resistivity measurement, the current source 820 is coupled via the current injection electrode 804 to deliver current to the well casing 790. A switch 822 of the electronics module 802 is set to a position to couple the current source 820 to receive the return current from the current return electrode 806. In response to this current injection, some of the current flows between the electrodes 804 and 806. However, some of the current flows into a formation 799 that surrounds the well casing 790, giving rise to a leakage current (called ΔI).

The V1 voltage is measured between across the electrode sets 808*a* and 808*b*, and the V2 voltage is measured between the electrode sets 808*c* and 808*d*. As shown in FIG. 19, in some embodiments of the invention, the electrode sets 808*b* and 808*c* may be electrically connected together. To measure the V1 and V2 voltages, the electronics module 802 may include amplifiers 832 and 834, respectively. In this manner, the input terminals of the amplifier 832 receive the V1 voltage, and the input terminals of the amplifier 834 receive the V2 voltage. The voltage difference between the V1 and V2 voltages is indicated by an amplifier 840 (of the electronics module 802) that has input terminals that are coupled to the output terminals of the amplifiers 832 and 834. More particularly, the output terminal 842 of the amplifier 840 indicates the resistivity (Rt), as defined as follows:

$$Rt=K*Vo/\Delta I, \qquad \text{Equation (1)}$$

where K is a constant, "Vo" is the voltage at the electrode sets 808*b* and 808*c* and ΔI, the leakage current, is defined as follows:

$$\Delta I=(V1-V2)/Rc \qquad \text{Equation (2)}$$

"Rc" is the casing resistance and may be measured by operating the switch 822 to connect the current source 820 to a surface electrode 830 (located at the surface of the well) instead of to the current return electrode 806 during a calibration mode of the tool 800. In this manner, during the calibration mode, the output terminal of the amplifier 840 indicates the Rc resistance at its output terminal 842.

In some embodiments of the invention, the packer may include a sensor that is disposed inside the tubing that extends through the packer for purposes of measuring fluids inside the tubing. For example, one or more sensors may be mounted inside the packer to measure a leakage current in this tubing, and the measured leakage current may be used as an indicator of the fluids inside the tubing.

Figure 2:
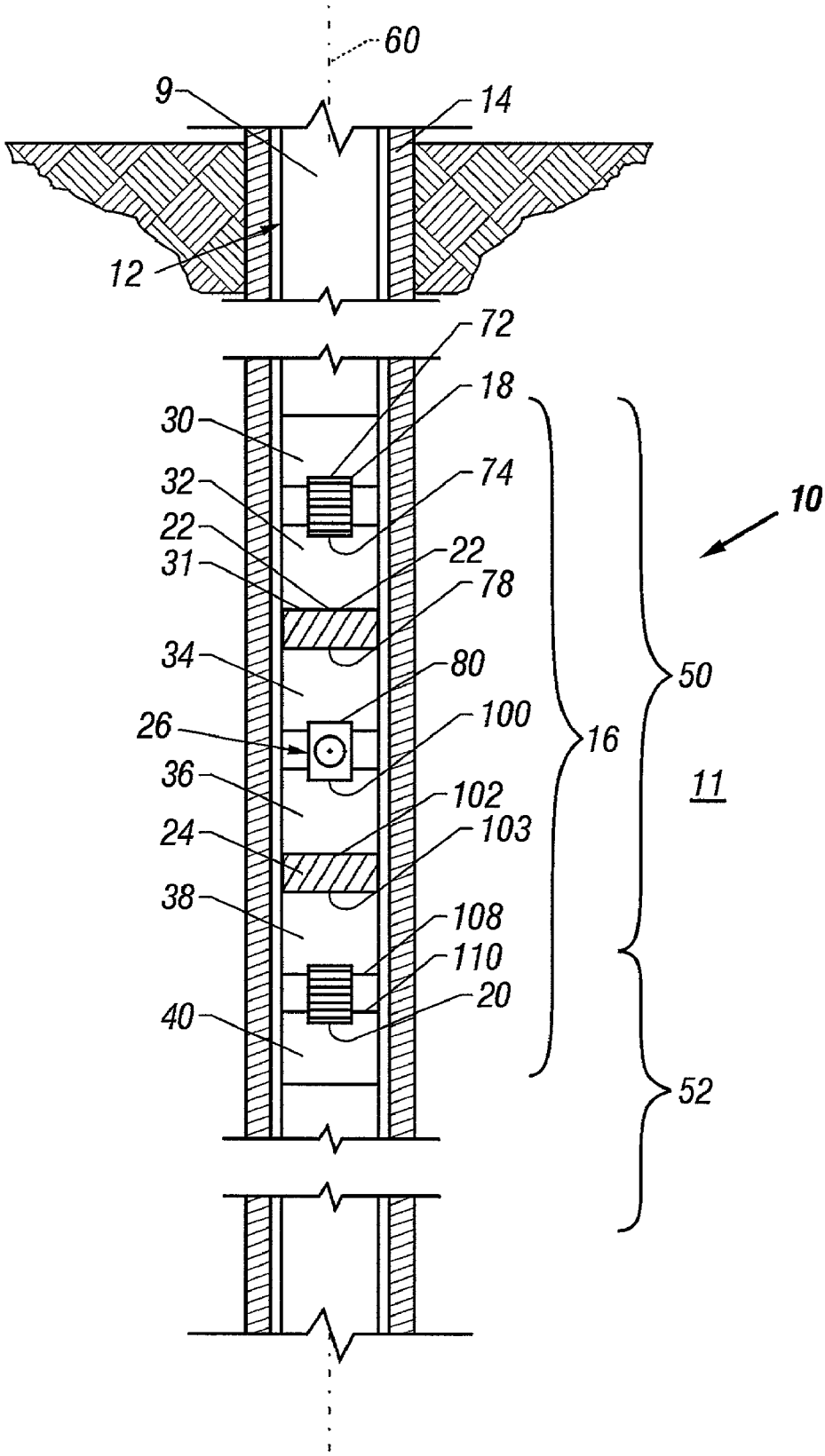

Turning now to a more specific example of a sensor assembly 4 that penetrates a well casing for purposes of performing a measurement, FIG. 2 depicts an embodiment 16 of a packer that includes at least one punch assembly 26 that may be used to pierce a casing 14 of a subterranean well 10 for purposes of establishing communication with a selected region 11 outside of the casing 14. For example, this region 11 may include a formation that surrounds the casing 14, including possibly cement that secures the casing 14 to a well bore of the well 10. By establishing communication with the region 11, one or more sensors (not shown in FIG. 2) of the packer 16 may perform measurements that are associated with the region 11. For example, sensor(s) of the packer 16 may be used to perform resistivity, pressure, gamma ray, gravity/force and nuclear magnetic resonance measurements (as just a few examples), depending on the type of sensor(s) that are located in the packer 16.

When deployed downhole, the packer 16 is part of a string 12 that extends from the surface of the well 10 and is used for purposes of communicating well fluid to the surface of the well. Besides the punch assembly 26 and its associated sensor(s), the packer 16 includes upper 22 and lower 24 annular sealing elements that are respectively located above and below the punch assembly 26. When the packer 16 is set, the punch assembly 26 pierces the well casing 14, and sleeves (described below) of the packer 16 compress the upper 22 and lower 24 sealing elements to form an annulus above the packer 16 as well as seal off the hole formed by the punch assembly 26 from an interior central passageway 9 of the well casing 14.

In some embodiments of the invention, the packer 16 includes a sensor to measure the penetration force that is required to pierce the casing and the rate at which the piercing occurs. In this manner, these parameters may be analyzed to understand the strength of the formation.

There are many ways to set the packer 16. Turning now to more specific details of one possible embodiment of the packer 16, when the packer 16 is set, upper 32 and lower 34 sleeves compress the upper sealing element 22 (that resides in between the sleeves 32 and 34), and upper 36 and lower 38 sleeves compress the lower sealing element 24 (that resides in between the sleeves 36 and 38). Also when the packer 16 is set, upper 18 and lower 20 dogs, or slips, extend radially to grip the interior wall of the well casing 14 to secure the packer 16 to the casing 14. The upper slips 18 (one being depicted in FIG. 2) may be regularly spaced around a longitudinal axis 60 of the packer 16 and located below the upper sealing element 22. The lower slips 20 (one being depicted in FIG. 2) may be regularly spaced around the longitudinal axis 60 of the packer 16 and located above the lower sealing element 24.

To obtain the force that is necessary to set the packer 16 (i.e., the force needed to compress the sealing elements 22 and 24; radially extend the upper 18 and lower 20 slips; and radially extend the punch assembly 26 to pierce the well casing 14), one of several techniques may be used. For example, the weight of the string 12 and possibly the weight of associated weight collars on the string 12 may be used to derive a force that is sufficient to set the packer 16. Alternatively, the central passageway 9 of the string 12 may be filled with fluid and pressurized to derive the force needed to set the packer 16. Yet another technique to set the packer 16 involves pressurizing fluid in the annular region between the exterior surface of the string 12 and the interior wall of the well casing 14. The latter technique is described herein, although it is understood that other techniques may be used to set the packer 16.

When the packer 16 is in the appropriate depth position to be set, the fluid in the annular region between the string 12 and the well casing 14 is pressurized to the point that a mechanical barrier, such as a shear pin, shears to permit a mandrel 40 to move in an upward direction and set the packer 16, as described below. The mandrel 40 may thereafter be held in the upper position by the downhole formation pressure. The mandrel 40 circumscribes the longitudinal axis 60.

As described further below, when the mandrel 40 moves in an upward direction, the mandrel 40 compresses elements (of the packer 16) that are located between an upper surface 110 of the mandrel 40 and a lower surface 72 of a stationary upper sleeve 30 of the packer 16 together. This compression, in turn, causes the upper 18 and lower 20 slips to engage the interior wall of the well casing 14, the sealing elements 22 and 24 to form seals against the well casing 14 and the punch assembly 26 to pierce the well casing 14, as further described below. After the punch assembly 26 pierces the well casing 14, measurements that are associated with the region 11 may then be taken.

More particularly, when the mandrel 40 moves in an upward direction to set the packer 16, the lower slips 20 are compressed between the upper surface 110 (of the mandrel 40) that is located below the slips 20 and a lower surface 108 of the sleeve 38 that is located above the slips 20. Although the sleeve 38 moves in an upward direction in response to the upward force that is exerted by the mandrel 40, the distance between the surfaces 108 and 110 decreases due to the non-movement of the upper sleeve 30 to force the slips 20 in radial outward directions to grip the interior wall of the well casing 14, as further described below.

The upward movement of the sleeve 38, in turn, causes an upper surface 103 of the sleeve 38 to exert a force against the lower sealing element 24. The lower sealing element 24, in turn, exerts force on a lower surface 102 of the sleeve 36. Although the sleeve 36 moves in an upward direction in response to this force, the distance between the upper 103 and lower 102 surfaces decreases due to the stationary upper sleeve 30 to exert a net compressive force on the lower sealing element 24 to force the lower sealing element 24 to expand radially toward the interior wall of the well casing 14.

In response to the upper travel of the mandrel 40, the sleeve 36 also moves upwardly so that an upper surface 100 of the sleeve 36 exerts an upward force against the punch assembly 26. This upward force causes the punch assembly 26 to move upwardly and exert a force on a lower surface 80 of the sleeve 34. Although the sleeve 34 moves in an upward direction in response to this force, the distance between the upper 100 and lower 80 surfaces decreases to drive the punch assembly 26 into and pierce the well casing 14, as further described below.

The upward movement of the sleeve 34, in turn, causes an upper surface 78 of the sleeve 34 to exert a force against the upper sealing element 22. In response to this force, the upper sealing element 22 exerts force on a lower surface 31 of the sleeve 32. Although the sleeve 32 moves in an upward direction in response to this force the distance between the upper 78 and lower 31 surfaces decreases to exert a net compressive force on the upper sealing element 22 to force the upper sealing element 22 to expand radially toward the interior surface of the well casing 14.

Lastly, the movement of the mandrel 40 causes an upper surface 74 of the sleeve 32 to exert upward forces against the upper slips 18, and in response to these forces, the upper slips 18 exert forces against a lower surface 72 of the sleeve 30. However, unlike the other sleeves, the sleeve 30 is stationary, thereby preventing upward movement of the sleeve 30 and causing the slips 18 to move in radially outward directions to grab the interior wall of the well casing 14, as described in more detail below.

Figure 3:
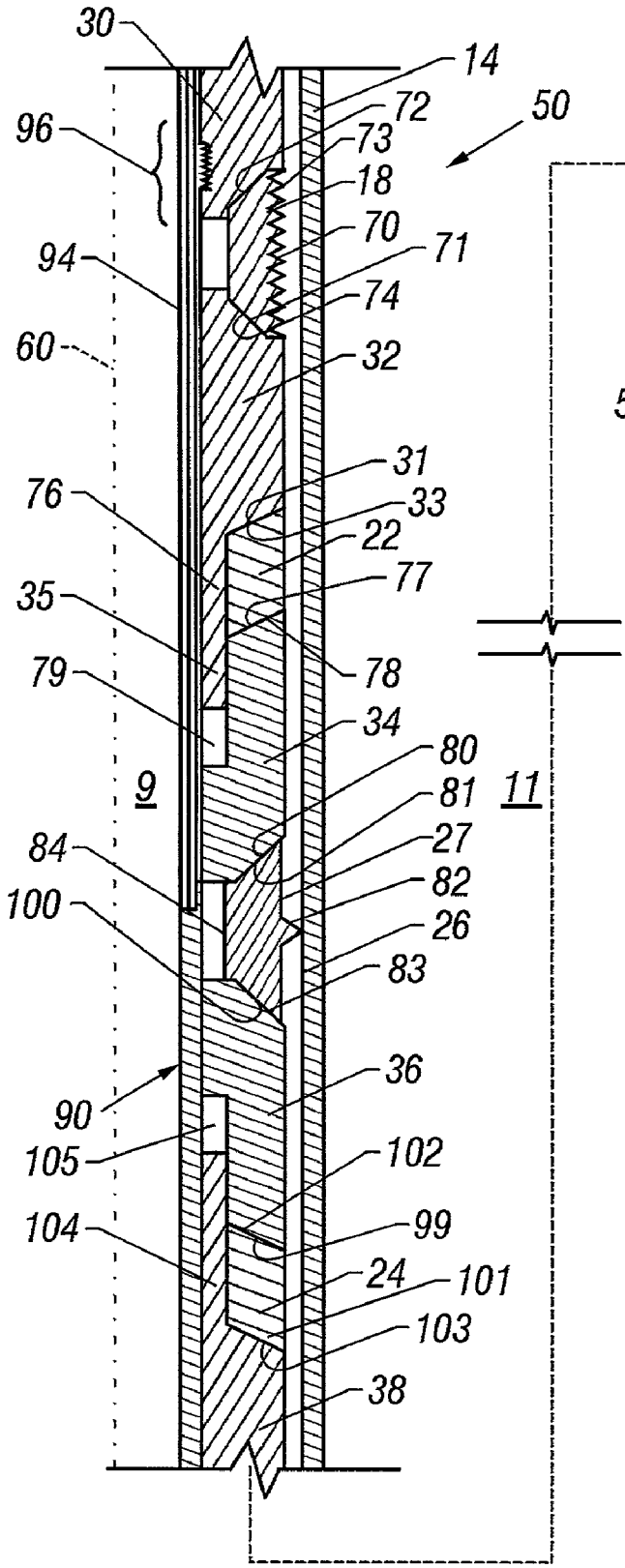
FIGS. 3 and 4 are schematic diagrams of a packer of FIG. 1 depicted in an unset state according to an embodiment of the invention.
Figure 4:
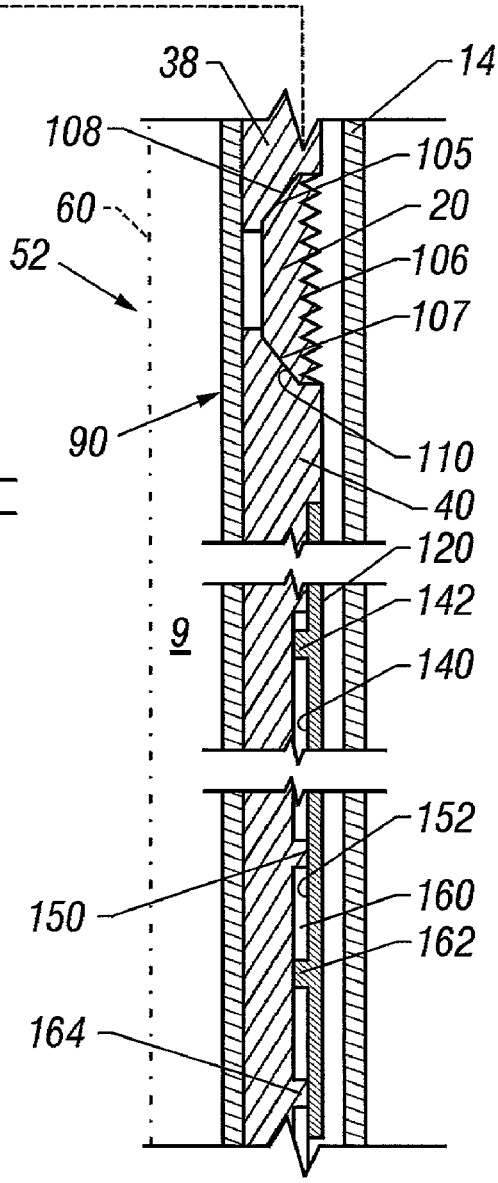
Figure 5:
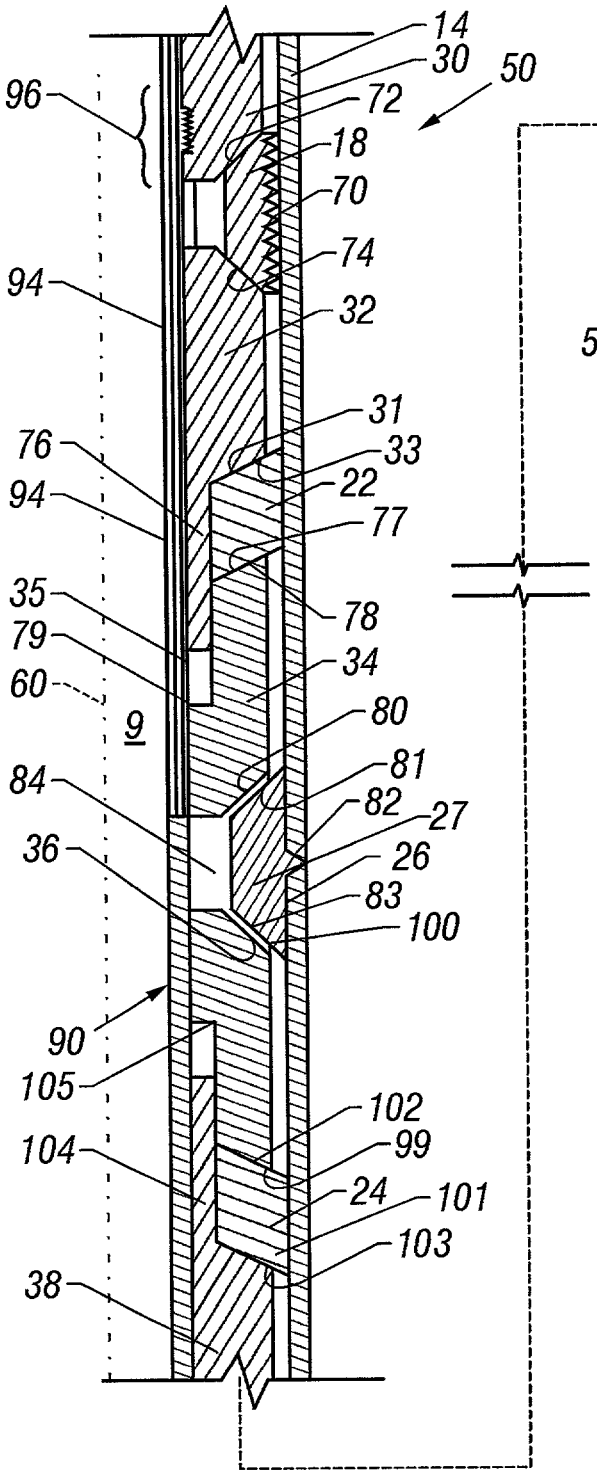
FIGS. 5 and 6 are schematic diagrams of the packer of FIG. 1 in a set state according to an embodiment of the invention.
Figure 6:
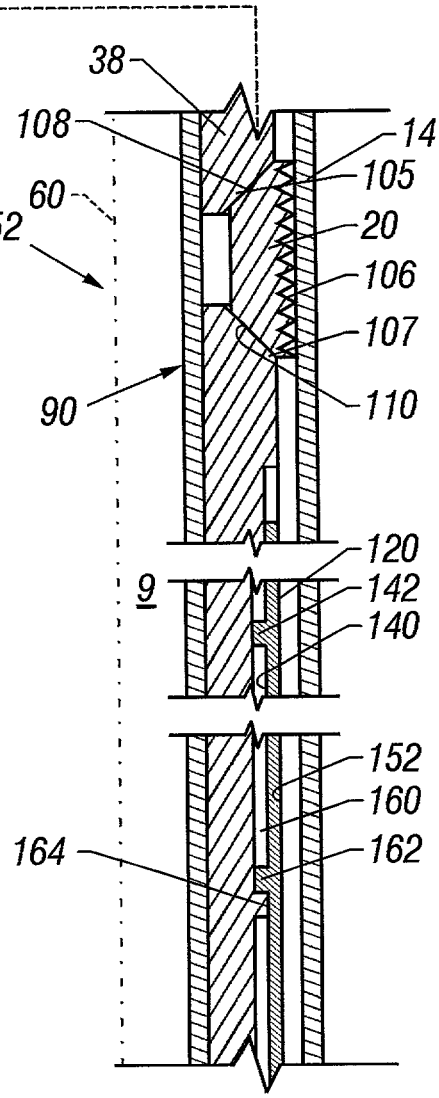

FIGS. 3 and 4 depict more detailed upper 50 (see FIG. 2) and lower 52 (see FIG. 2) sections, respectively, of the packer 16 in its unset state, according to some embodiments of the invention. FIGS. 5 and 6 are schematic diagrams of the upper 50 and lower 52 sections, respectively, of the packer 16 in its set state, according to some embodiments of the invention. In FIGS. 3, 4, 5 and 6, only one half of the cross-section of the packer 16 is depicted, with the missing cross-sectional half being derived from rotating the depicted cross-section about the longitudinal axis 60. Alternative embodiments may have an eccentricity in which the well bore is eccentric with respect to the housing of the packer 16.

Referring to FIG. 4, in some embodiments of the invention, the mandrel 40 generally circumscribes a tubular cylindrical inner housing 90 of the packer 16 and includes a piston head 150. The inner passageway of the inner housing 90 forms at least part of the central passageway 9, a passageway that remains isolated (from fluid communication) from the region that is located between the sealing elements 22 and 24 and on the exterior of the string 12. The lower surface of the piston head 150 is in communication with a chamber 160 that receives fluid via radial ports 152 (one port 152 depicted in FIG. 4) from the annular region between the string 12 and the well casing 14; and the upper surface of the piston head 150 is in communication with a chamber 140 that contains a fluid that exerts a significantly lower pressure than the pressure that is exerted by the fluid inside the chamber 160. As an example, the chamber 140 may contain fluid that exerts approximately atmospheric pressure against the upper surface of the piston head 150. The chamber 160 is formed from an annular cavity that is created between the exterior sidewall of the mandrel 40 and the interior sidewall of a cylindrical outer housing 120 (of the packer 16) that circumscribes the mandrel 40.

The lower end of the chamber 160 is sealed via an extension 162 of the outer housing 120, an extension that radially extends inwardly into the mandrel 40. One or more O-rings exist between the extension 162 and the mandrel 40 and reside in one or more annular notches of the extension 162. The upper end of the chamber 160 is sealed via the piston head 150 that includes one or more annular notches for holding one or more O-rings to form this seal. The upper end of the chamber 140 is sealed via an extension 142 of the outer housing 120, an extension that radially extends inwardly into the mandrel 40. One or more O-rings exist between the extension 142 and the mandrel 40 and reside in one or more annular notches of the extension 142. The lower end of the chamber 140 is sealed via the O-ring(s) in the piston head 150.

Although when the packer 16 is run downhole the pressure differential between the two chambers 140 and 160 exerts a net upward force on the mandrel 40, the travel of the mandrel 40 is initially confined by a shear pin 164. Therefore, when the packer 16 is to be set, the pressure of the fluid in the annular region between the string 12 and the well casing 14 is increased (via a pump at the surface of the well) to a sufficient level to cause the shear pin 164 to shear, thereby permitting the mandrel 40 to move upwardly to set the packer 16. The set position of the mandrel 40 is maintained via the downhole formation pressure.

Referring to FIG. 4, the mandrel 40 generally circumscribes the inner housing 90 and the longitudinal axis 60. The upper surface 110 of the mandrel 40 is an inclined annular surface that has a surface normal that points in an upper direction and away from the longitudinal axis 60. The upper surface 110 contacts complementary inclined lower surfaces 107 of the lower slips 20. The lower surface 108 of the sleeve 38 is an inclined annular surface and has a surface normal that points in a downward direction and away from the longitudinal axis 60. The lower surface 108 contacts complementary inclined upper surfaces of the lower slips 20. Due this arrangement, when the mandrel 40 moves in an upward direction, the lower slips 20 are pushed outwardly into the interior wall of the well casing 14 so that teeth 106 of the lower slips 20 are thrust against the well casing 14 to secure the packer 16 to the casing 14, as depicted in FIG. 6.

Referring to FIGS. 3 and 4, the sleeve 38 circumscribes the inner housing 90 and the longitudinal axis 60. The upper surface 103 of the sleeve 38 is an inclined annular surface and has a surface normal that points in an upper direction and away from the longitudinal axis 60. The upper surface 103 contacts a complementary inclined annular surface 101 of the lower sealing element 24. As shown, the sleeve 38 includes an upper annular extension 104 that is circumscribed by the lower sealing element 24 so that the element 24 is supported on its inner sidewall surface during compression of the element 24 when the packer 16 is set.

An upper surface 99 of the lower sealing element 24 abuts the lower surface 102 of the sleeve 36. The sleeve 36 circumscribes the inner housing 90 and the longitudinal axis 60.

The upper surface 99 of the sealing element 24 is an inclined annular surface and has a surface normal that points in an upper direction and away from the longitudinal axis 60. The upper surface 99 contacts the complementary inclined annular lower surface 102 of the sleeve 36. As shown, the sleeve 36 includes an inner annular groove 105 that receives the upper extension 104 of the sleeve 38 and allows space for the sleeve 38 to move when the packer 16 is set. Thus, due to the upper extension 104 and the surfaces 102 and 103, when the packer 16 is set, the distance between the surfaces 102 and 103 decreases to force the sealing element 24 to expand toward the well casing 14, as depicted in FIG. 5.

Referring to FIG. 3, the upper surface 100 of the sleeve 36 is an inclined annular surface and has a surface normal that points in an upper direction and away from the longitudinal axis 60. The upper surface 100 contacts a complementary inclined surface 83 of a punch 27 of the punch assembly 26. An upper surface 81 of the punch 27 contacts the complementary inclined annular lower surface 80 of the sleeve 34. Due to this arrangement, when the packer 16 is set, the upward movement of the mandrel 40 compresses the distance between the lower surface 80 of the sleeve 34 and the upper surface 100 of the sleeve 36. As a result, the punch 27 is forced in a radially outward direction into the interior sidewall of the well casing 14 so that a point 82 of the punch 27 pierces the well casing 14, as depicted in FIG. 5.

The sleeve 34 circumscribes the inner housing 90 and the longitudinal axis 60, as depicted in FIG. 3. An annular notch 79 is formed in the sleeve 34 for receiving a lower extension 35 of the sleeve 32. The upper surface 78 of the sleeve 34 is an inclined annular surface and has a surface normal that points in an upper direction and toward the longitudinal axis 60. The upper surface 78 contacts a complementary inclined annular surface 77 of the upper sealing element 22. An upper surface 33 of the upper sealing element 22, in turn, is an inclined annular surface and has a surface normal that points in an upper direction and toward the longitudinal axis 60. The upper surface 33 contacts the complementary inclined annular lower surface 31 of the sleeve 32. Due to the lower extension 35 of the sleeve 32 and the surfaces 31 and 78, when the packer 16 is set, the distance between the surfaces 31 and 78 decreases to force the upper sealing element 22 to expand toward the interior sidewall well casing 14, as depicted in FIG. 5.

As shown in FIG. 3, the sleeve 32 circumscribes the inner housing 90 and the longitudinal axis 60. The sleeve 32 includes the upper surface 74, a surface that is an inclined annular surface and has a surface normal that points in an upper direction and away from the longitudinal axis 60. The upper surface 74 of the sleeve 32 contacts corresponding complementary inclined surfaces 71 of the upper slips 18. Upper surfaces 73 of the upper slips 18 are inclined and have surface normals that each point in an upper direction and away from the longitudinal axis 60. The upper surfaces 73 contact the complementary annular inclined lower surface 72 of the stationary sleeve 30, a sleeve that, for example, has a threaded connection 96 with the inner housing 90 to prevent the sleeve 30 from moving relative to the other sleeves. Due to this arrangement, when the sleeve 32 moves in an upward direction when the packer 16 is set, the upper slips 18 are pushed outwardly into the interior sidewall well casing 14 so that teeth 70 of the upper slips 18 are thrust against the interior sidewall of the well casing 14, as depicted in FIG. 5.

In some embodiments of the invention, the punch assembly 26 includes circuitry to measure a characteristic of the region 11 that surrounds the casing 14 near when the punch 27 pierces the well casing 14. A cable 84 may be used to communicate the measured characteristic(s) from the punch assembly 27. In this manner, in some embodiments of the invention, the cable 84 extends from the punch assembly 26 uphole and is located inside a longitudinal passageway 94 of the inner housing 90. The cable 84 may be a wire cable or may be a fiber optics cable.

As an example, the cable 84 may extend to the surface of the well and communicate an electrical signal that indicates the measured characteristic(s) after the packer 16 has been set and the punch 27 has penetrated the well casing 14. Alternatively, in other embodiments of the invention, the cable 84 may extend to a downhole telemetry interface that has a transmitter for transmitting an indication of the measured characteristic(s) uphole. As another example, the housing 90 itself may be used to communicate this indication (via acoustic telemetry, for example) or another cable may be used to communicate this indication uphole. Other uphole telemetry systems may be used. Alternatively, the packer 16 may include electronics to store an indication of the measured characteristic(s) in a semiconductor memory so that the indication may be retrieved when the packer 16 is retrieved, or the packer 16 may include a data link device, such as an inductive coupling. Other variations are possible.

Figure 7:
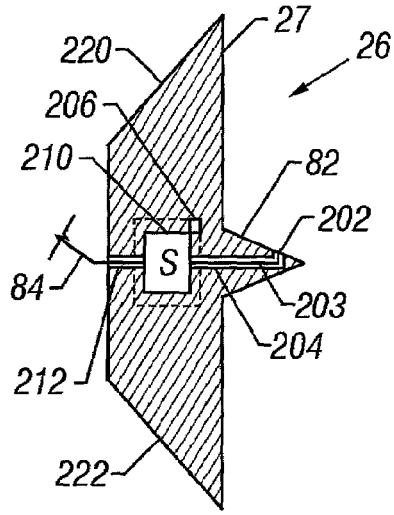
FIG. 7 is a more detailed schematic diagram of a punch assembly of the packer according to an embodiment of the invention.

Referring to FIG. 7, in some embodiments of the invention, the punch 27 may be formed from a metallic body (a metallic body made from titanium, for example) and include a conical point 82 of a sufficiently small conical angle to generate the force needed to penetrate the well casing 14. The punch 27 may also include a cavity 212 to house a sensor 206 of the punch assembly 26. As an example, the sensor 206 may be a resistivity, pressure, gravity/force, gamma ray or nuclear magnetic resonance sensor, as just a few examples. The sensor 206 may also be a strain gauge or an accelerometer. For embodiments where the sensor 206 is a resistivity sensor, the sensor 206 may be coupled to a probe 203 that extends through a passageway to an exit near the tip of the point 82. The probe 203 may be electrically isolated from the metallic body that forms the punch 27. The passageway may include, for example, a radially extending conduit 204 that extends toward the tip of the point 82 and an upwardly extending conduit 202 that emerges in the conical sidewall of the point 82 near the tip. In other embodiments of the invention, the passageway may not include the probe 203. Instead, the passageway may be used to communicate well fluid to the sensor 206. Other variations are possible. A conduit, such as the passageway 212, may also be formed in the punch 27 for purposes of routing the cable 84 from the sensor 206 to a region outside of the punch assembly 26.

In some embodiments of the invention, the sensor 206 may be a metallic probe, and thus, the probe 206 may form an electrode for measuring resistivity, for example. Thus, in these embodiments, the conduit 202 may not be needed. In other embodiments of the invention, the sensor 206 may be formed from a non-conductive material to minimize casing shorting and maximize the signal-to-noise ratio (SNR).

Other embodiments are within the scope of the following claims for the puncture-type sensor assembly. For example, multiple punch assemblies may be used to establish an array. As a more specific example, resistivity transmitters and receivers may be located in various punch assemblies that are spaced longitudinally along the well casing 14 to establish a resistivity array. Each transmitter transmits a current, and the currents received by the receivers may be used to indicate resistivity measurements for the surrounding formations. In some embodiment of the invention, the sensor(s) 206 may measure pressure(s) in one or more gas, oil or water regions of the formation.

Figure 11:
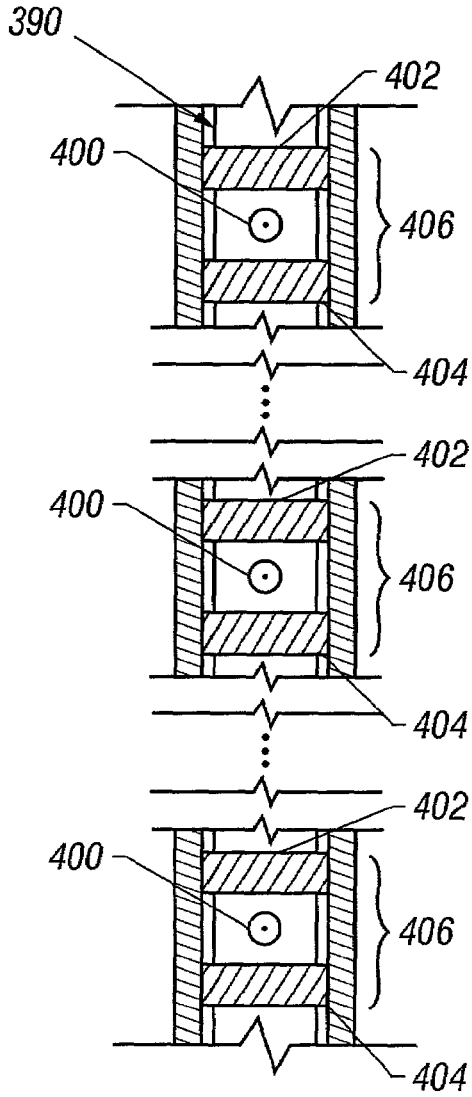
Figure 12:
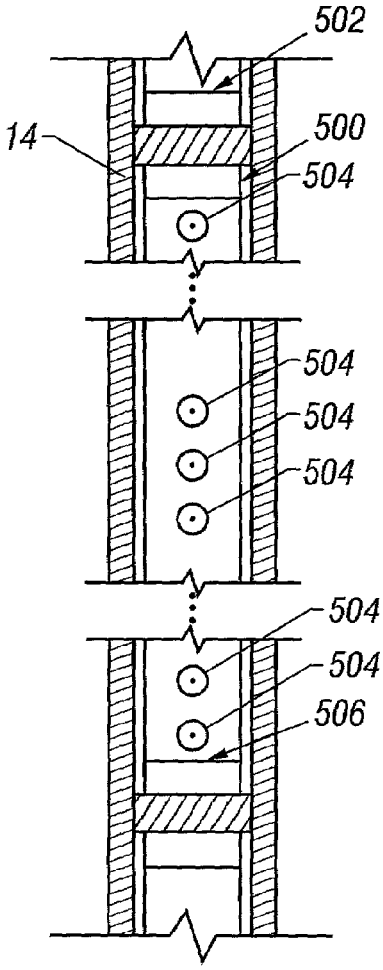

As an example of such an array, FIG. 11 depicts a string 390 that includes multiple packers 406, each of which includes a punch assembly 400. In this manner, each packer 406 includes upper 402 and lower 406 sealing elements 402 above and below, respectively, the associated punch assembly 400. More than one punch assembly 400 may be located in one of the packers 406. FIG. 12 depicts a string 500 that forms an array from multiple punch assemblies 504 that are located and spaced apart between an upper packer 502 and a lower packer 506. Other variations are possible.

As an example of another embodiment of the invention, the sensor 206 may be located behind the punch assembly 26, an arrangement that keeps the cable 84 from moving with the punch assembly 26.

Figure 8:
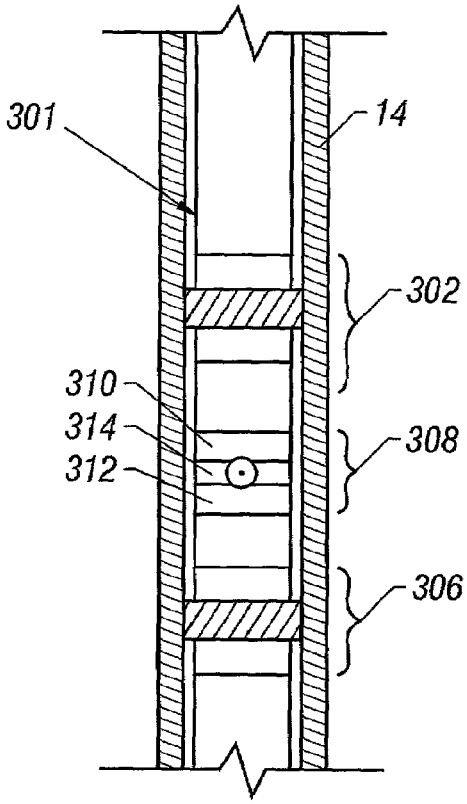
FIGS. 8, 9, 10, 11 and 12 are schematic diagrams of different strings according to different embodiments of the invention.

FIG. 8 depicts an embodiment of the invention that includes a string 310 with two packers 302 and 306 that form an isolated region in between for conducting measurements. In this manner, a punch assembly 314 may be located between the two packers 302 and 306 and be used to pierce the well casing 14 when sleeves 310 and 312 (for example) force the punch assembly 314 into the casing 14. Thus, as depicted in FIG. 5, the punch assembly 314 may be part of a tool that is separate from the packers 302 and 306. This tool may also include a sensor to perform a downhole measurement when the well casing 14 is pierced.

Figure 9:
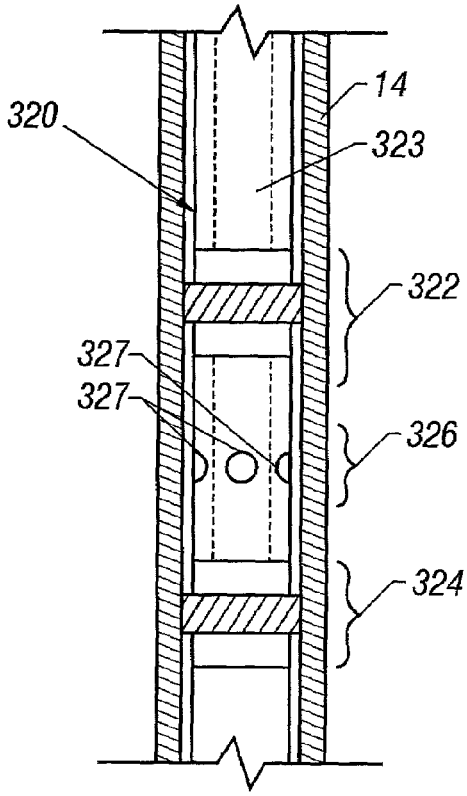

In some embodiments of the invention, the punch may be replaced by another puncture device, such as a shaped charge, for example. In this manner, referring to FIG. 9, a string 320 includes one or more shaped charges 327 that are located between packers 322 and 324 of the string 320. In this manner, the shaped charges pierce the well casing 14 to permit communication between sensors and the outside of the well casing 14. It is noted that the piercing of the well casing 14 by the shaped charges 327 does not establish fluid communication between the exterior of the well casing 14 and a central passageway 323 of the string 320. Thus, an annular sealed region between the packers 322 and 324 is created for performing measurements.

Figure 10:
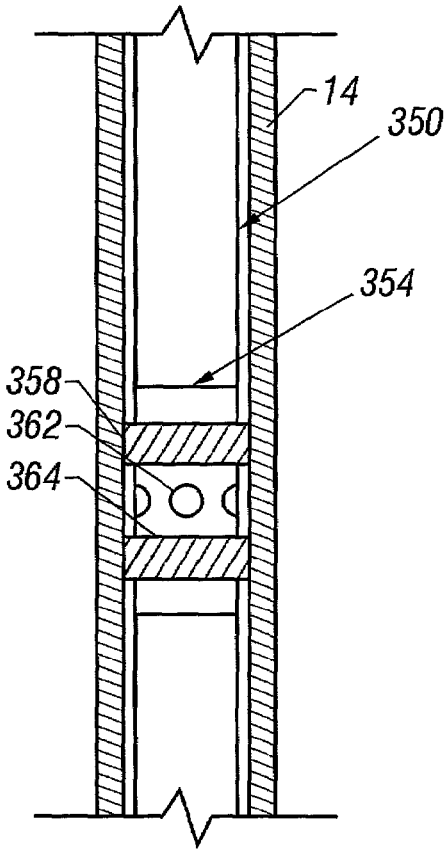

FIG. 10 depicts yet another embodiment, a string 350 that includes a packer 354 that uses one or more shaped charges 362 between its upper 358 and lower 364 sealing elements to pierce the well casing 14. Thus, the packer 354 has a similar design to the packer 16, with the punch assembly 26 of the packer 16 being replaced by one or more shaped charges 362. The packer 354 also includes a sensor to measure a property associated with the region outside of the well casing 14 where the shaped charges 362 pierce the well casing 14.

Thus, the various strings described above establish an upper seal and a lower seal with the interior wall of the well casing near a region of the well in which measurements are to be taken. The seals create a sealed annular space inside the well casing, and this annular space is in communication with the region due to the piercing of the well casing via a puncture device of the string. A sensor of the string may then take measurements due to this communication.

Figure 20:
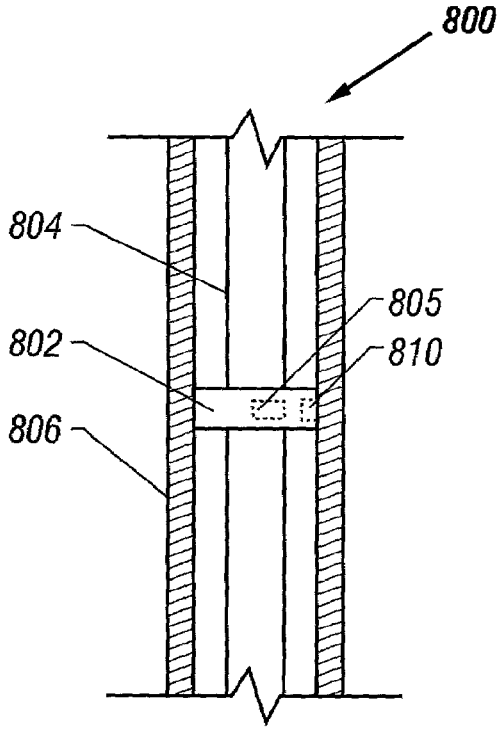
FIGS. 20 and 21 are schematic diagrams depicting a packer according to another embodiment of the invention.

Other embodiments are within the scope of the following claims. For example, referring to FIG. 20, in some embodiments of the invention, an arrangement 800 may be used. In this arrangement 800, a packer 802 includes a projectile deployment device 810 to pierce a well casing 806. In this manner, the packer 802 may be part of a string 804 that is lowered downhole inside a wellbore that is cased by the casing 806. Due to this technique, the casing 806 may be penetrated via a projectile that is fired by the projectile deployment device 810 for purposes of performing downhole measurements without requiring the punch assembly that is described above.

Figure 21:
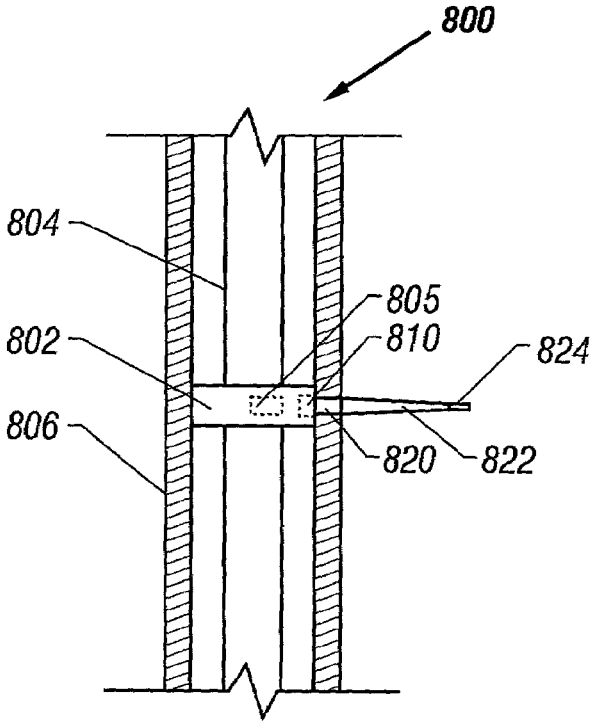

Referring also to FIG. 21, when initially deployed downhole the projectile deployment mechanism 810 includes a bullet that is oriented in a radial direction toward the casing 806. When the packer 802 is in the appropriate position downhole, a piston may be actuated by a variety of techniques to cause firing of the bullet. The firing of the bullet, in turn, produces a projectile 824 that forms a perforation 822 in the casing 806 and extends into the surrounding formation, as depicted in FIG. 21. Depending on the particular embodiment of the invention, the projectile 824 is in communication with a receiver 805 via either a wireless link or a wired tethered link. However, regardless of the physical and electrical connections between the projectile 824 and the receiver 805, the projectile 824 includes a sensor (such as one of the many sensors described herein, for example) that communicates formation characteristics back to the receiver 805. A variety of telemetry techniques may be used to establish communication between the receiver 805 and uphole electronics. Other variations are possible.

The projectile 824 and sensor may initially be part of a shell, as further described in U.S. Pat. No. 6,234,257, entitled, "DEPLOYABLE SENSOR APPARATUS AND METHOD," granted May 22, 2001.

In the foregoing description, directional and orientation-related terms such as upper, lower, etc. were used to describe the strings and their associated features. However, such directions and orientations are not needed to practice the invention, as the scope of the invention is defined by the appended claims.

While the invention has been disclosed with respect to a limited number of embodiments, those skilled in the art, having the benefit of this disclosure, will appreciate numerous modifications and variations therefrom. For example, any manner or arrangement of setting the slips, elements and punch may be used. It is intended that the appended claims cover all such modifications and variations as fall within the true spirit and scope of the invention.

What is claimed is:

1. A method usable with a subterranean well having a casing, the method comprising:

producing fluid from the well;

using a non-acoustic sensor during the producing to measure a characteristic in a region of the well outside of the casing;

placing the sensor in a packer;

deploying the packer downhole;

setting the packer;

engaging a slip to secure the packer to the casing;

positioning the sensor against an interior wall of the casing in response to the setting of the packer; and puncturing the casing to measure the characteristic.

2. The method of claim 1, wherein the sensor comprises a resistivity sensor, a nuclear sensor, a gravity/force sensor, a pressure sensor or a temperature sensor.

3. An apparatus usable with a subterranean well having a casing, the apparatus comprising:

a punch adapted to be positioned inside a passageway of the casing and pierce the casing to establish communication with a region outside of the casing, the punch adapted to move to pierce the casing in response to a packer being set; and a sensor adapted to be positioned inside the passageway of the casing to indicate a characteristic associated with the region.

4. The apparatus of claim 3, further comprising:

sealing elements to seal off a portion of the casing pierced by the punch.

5. The apparatus of claim 3, wherein the punch includes a cavity and the sensor is located inside the cavity.

6. The apparatus of claim 3, further comprising:

sleeves to compress the punch to force the punch into the casing.

7. The apparatus of claim 3, wherein the punch includes another passageway to establish communication between the region and the sensor.

8. The apparatus of claim 3, further comprising:

sealing elements; and sleeves to concurrently force the punch into the casing and compress the sealing elements.

9. A method usable with a subterranean well having a casing, the method comprising:

providing a puncture device inside a packer; and actuating sleeves to force the punch into the casing when the packer is set to pierce the casing to establish communication with a region outside of the casing.

10. The method of claim 9, further comprising:

sensing a characteristic of the region outside of the casing via the communication established by the puncture device.

11. The method of claim 9, wherein the sensing comprises sensing one of a resistivity, a pressure, a nuclear measurement and a gravity.

12. The method of claim 9, further comprising sealing off a portion of the casing pierced by the punch.

13. The method of claim 9, wherein the puncture device comprises a punch.

14. A method usable with a subterranean well, comprising:

establishing a sealed region downhole, including setting multiple spaced packers;

within the sealed region, piercing a casing of the well; and without flowing fluids uphole from the sealed region, using the pierced casing to measure a characteristic associated with a region outside of the casing.

15. The method of claim 14, wherein the establishing comprises:

setting at least one packer downhole.

16. The method of claim 14, wherein the piercing comprises:

using a punch.

17. The method of claim 14, further comprising:

selecting the region to measure one of a gravity, pressure, resistivity and nuclear measurement associated with the region.

18. A method usable with a subterranean well, comprising:

establishing at least one sealed region downhole;

in said at least one sealed region, piercing a casing of the well; and without flowing fluids uphole from the sealed region, using the results of the piercing to establish an array of downhole sensors.

19. The method of claim 18, wherein the establishing comprises:

setting at least one packer downhole.

20. The method of claim 18, wherein the piercing comprises:

using a punch.

21. The method of claim 18, wherein the establishing comprises:

setting multiple spaced packers.

22. The method of claim 18, further comprising:

selecting the region to measure one of a gravity, pressure, resistivity and nuclear measurement associated with the region.

23. The method of claim 18, further comprising:

measuring a force associated with the piercing; and using the measured force to derive a strength of a formation.

24. The method of claim 18, further comprising:

measuring a rate associated with the piercing; and using the measured rate to derive a strength of a formation.

25. An apparatus usable with a subterranean well having a casing, the apparatus comprising:

a punch to be positioned inside a passageway of the casing and pierce the casing to establish communication with a region outside of the casing; and a sensor to be positioned inside the passageway of the casing to indicate a resistivity associated with the region.

26. An apparatus usable with a subterranean well having a casing, the apparatus comprising:

a punch to be positioned inside a passageway of the casing and pierce the casing to establish communication with a region outside of the casing; and a sensor to be positioned inside the passageway of the casing to indicate a nuclear measurement associated with the region.

27. An apparatus usable with a subterranean well having a casing, the apparatus comprising:

a punch to be positioned inside a passageway of the casing and pierce the casing to establish communication with a region outside of the casing; and a sensor to be positioned inside the passageway of the casing to indicate a density associated with the region.

28. An apparatus usable with a subterranean well having a casing, the apparatus comprising:

a punch to be positioned inside a passageway of the casing and pierce the casing to establish communication with a region outside of the casing;

a sensor to be positioned inside the passageway of the easing to indicate a characteristic associated with the region; and at least one slip to secure the apparatus to the casing, wherein the punch includes a cavity and the sensor is located inside the cavity.

29. The apparatus of claim 28, wherein the punch moves to pierce the casing in response to a packer being set.

30. The apparatus of claim 28, further comprising:

sleeves to compress the punch to force the punch into the casing.

31. The apparatus of claim 28, wherein the punch includes another passageway to establish communication between the region and the sensor.

32. A packer comprising:

a tubular member;

sealing elements to form seals between the tubular member and a well casing and form a sealed region between the seals;

a puncture device to be positioned inside a passageway of the casing and pierce the casing to establish communication with a region outside of the casing, the puncture device comprising a punch;

a sensor to be positioned inside the passageway of the casing to indicate a characteristic associated with the region outside of the casing; and sleeves to force the punch into the casing.

33. The packer of claim 32, wherein the sleeves concurrently force the punch into the casing and compress the sealing elements.

34. The packer of claim 32, wherein the packer comprises a hydraulically set packer.

35. The packer of claim 32, wherein the puncture device includes a passageway to establish communication between the region and the sensor.

36. A system usable with a subterranean well having a casing, the system comprising:

a non-acoustic sensor to measure a characteristic of a region of the well outside the casing;

a packer connected to the sensor and adapted to position the sensor against an interior wall of the casing in an expanded state of the packer, the packer comprising at least one slip to secure the packer to the casing; and a puncture device attached to the packer to puncture the casing to permit the sensor to measure the characteristic.

37. The system of claim 36, wherein the sensor is part of a network of sensors.

38. The system of claim 36, wherein the sensor comprises a resistivity sensor, a nuclear sensor, a gravity/force sensor, a pressure sensor or a temperature sensor.

39. The system of claim 36, wherein the sensor is adapted to measure the characteristic without requiring puncturing of the well casing.

* * * * *